US005755655A

United States Patent [19]

Bohn et al.

[11] Patent Number: 5,755,655

[45] Date of Patent: May 26, 1998

[54] PROCESSING DEVICE FOR A LAYER-TYPE MATERIAL

[75] Inventors: Martin Bohn, Reutlingen; Wolfgang Scheller, Oberpleichfeld, both of Germany

[73] Assignee: bielomatik Leuze GmbH & Co., Germany

[21] Appl. No.: 625,697

[22] Filed: Apr. 3, 1996

[30] Foreign Application Priority Data

Apr. 11, 1995 [DE] Germany ..... 195 13 688.8

[51] Int. Cl.[6] ..... B65H 45/22

[52] U.S. Cl. ..... 493/439; 493/440; 493/455

[58] Field of Search ..... 493/417, 439, 493/440, 455, 456, 443

[56] References Cited

U.S. PATENT DOCUMENTS

| | | | |
|---|---|---|---|
| 1,986,857 | 1/1935 | Roberts | 493/417 |
| 2,490,930 | 12/1949 | Thompson | 493/439 |
| 4,421,501 | 12/1983 | Scheffer | 493/439 |
| 4,578,051 | 3/1986 | Everman . | |
| 4,721,504 | 1/1988 | Cogswell | 493/440 |
| 4,725,218 | 2/1988 | Timmons | 493/440 |
| 4,820,252 | 4/1989 | Osborn | 493/440 |

FOREIGN PATENT DOCUMENTS

| | | |
|---|---|---|
| 2515053 | 11/1975 | Germany . |
| 2937524 | 4/1980 | Germany . |
| 3806188 | 6/1989 | Germany . |
| 94 17 614.0 | 6/1994 | Germany . |
| 1214529 | 12/1970 | United Kingdom . |
| 1595018 | 8/1981 | United Kingdom . |

*Primary Examiner*—Jack W. Lavinder
*Attorney, Agent, or Firm*—Quarles and Brady

[57] ABSTRACT

A device for folding layer material, the layer material defining layer sections including at least one folded layer section and a connecting layer section laterally directly connecting to the at least one folded layer section, comprises: a device base; a conveying path for conveying the layer material relative to the device base in a conveying direction along a folding path section; and, a folding member including guiding members for longitudinally folding the layer material from an initial layer state to a folded state only within the folding path section while the layer material is conveyed therethrough. The folding path section defines folding path ends including a beginning end where the layer material initially begins to be folded by partly erecting the at least one folded layer section from the initial layer state with respect to the connecting layer section and with respect to the device base, and a finishing end where the layer material reaches and then maintains the folded state. The guiding members deflect the connecting layer section while simultaneously folding the at least one folded layer section to the folded state from the beginning to the finishing ends. A first guide member engages the layer material on a first side and a second guide member engages the layer material on a second side while opposing the first guide member. The first and second guide members are positionally adjustable about a substantially common guide axis. The folding member can comprise a plow folder.

22 Claims, 3 Drawing Sheets

PROCESSING DEVICE FOR A LAYER-TYPE MATERIAL

BACKGROUND OF THE INVENTION

The invention refers to a device for the processing of layer-type materials, i.e. materials having bending characteristics similar to those of writing paper, flexible plastic foil or similar, processed, for instance, by cross cutting of a material web to obtain layers of sheets. It is the task of the device to guide a material web at high speed and simultaneously at a preset tensile stress such that laterally juxtaposed longitudinal material sections can reciprocally be displaced around a connecting and/or pivot zone oriented parallel to the conveying direction while maintaining the said one-part connection. During the said process, the sections may be pivoted in relation to each other by more or less than 90°, in the case of a creaser and/or a plough creaser, for instance, by around 180°, in order to be stacked on each other on completion of processing.

In a creaser or similar of the said type it is difficult to fold two lateral strips of a material web over a rather short finite length, allowing the said strips not to have the same width as provided with a symmetrically staggered type of an apse crease and/or permitting to be possibly folded overlapping each other based on equal strip widths. Only with processing a symmetrical apse crease the two processing sections coincide to make one section. This section commences at the deflection perimeter of a cross deviation of the material web, followed by a deviation apex and ending in a deflecting end. For instance, a central longitudinal section of the material web is deviated between deflection points only by two V-shaped planar legs, whilst the lateral longitudinal sections are folded in a helix-shaped twist from a flat position into a top layer position. Erection of the lateral longitudinal strip commences at the inlet, reaching approximately 90° to the central section of the web at the apex, with the folding process ending at the outlet.

OBJECTS OF THE INVENTION

An object of the invention is to provide a device in which the disadvantages of known designs and/or the described type will be avoided, allowing in particular a variable deformation of the layer material over a reduced and/or minimum length.

SUMMARY OF THE INVENTION

According to the invention, for instance, two lateral and/or outermost longitudinal strips or other material sections, provided on either side of a single central longitudinal strip, are to be moved against each other over a longitudinal path length, as described, with the path length being shorter than three times that path length which is required in order to transfer only one of the material sections from its coplanar position to its preset final position. The inlet, for instance, for transferring a second material section can follow directly and/or at a small distance the outlet for transferring the first material section or can be formed by the said outlet.

It is particularly useful, however, when both lateral material sections are transferred simultaneously in cross direction to the path plane into folded position, with the transfer of the second or shorter section and/or the section to be folded under the other section being effected faster and/or over a shorter distance than that of the first section. Cross movement of the second section, which ended prior to completion of transfer of the first section, will commence only after the first section has started its cross transfer.

Irrespective of the above, it is of advantage if guide faces are provided on both layer sides of the material in order to guide at least one section, for instance the central section, the laterally connecting longitudinal section and/or their connecting area. These guide faces may define a guide gap, being only marginally wider than the material thickness, for instance five to eight times wider. Transverse and/or parallel to the longitudinal and/or conveying direction, the gap can only have line-like and/or point-like extension, for instance be bounded on either side by faces of different curvature or by a flat and a curved face or by two curved areas, allowing very accurate anti-vibration guidance of the material even at high speeds.

Irrespective of the above, guidance of the material, for instance the lateral longitudinal section or the connecting zone, is preferably based on a moving runner running with the guided area at a similar speed, resulting in very gentle, low-friction and low-wear guiding of the material. The guide face of the guide member is preferably arranged approximately parallel to the path plane. Each of the said gap and/or guide faces may be rigid or dimensionally stable and/or designed as a very smooth surface similar to a polished surface.

Irrespective of the above, conversion means have been provided according to the invention by which the material may be folded optionally up or down in the same path length or in the case of approximately vertical guidance of the material to the right-hand and left-hand side of the path plane, with at least one to all of the said gap or guide faces being alternately used or relocated for both types of creases.

Irrespective of the above, in each case two guide members in pairs are jointly adjustably arranged and are provided to opposingly guide the material on both layer sides directly opposite each other. Adjustment may be continuously effected in cross direction to the longitudinal direction and therefore across and/or parallel to the sectional or path plane, independently for each guide member, for instance in order to adjust the degree of deviation of the central material section or to change the working width. This results in a high creasing variability, with each guide gap maintaining its gap width irrespective of any adjustment. This gap width could furthermore be continuously variable or adjusted in minimum steps by exchangeably arranging spacers of different thicknesses between fastening seatings or faces in a non-destructive manner.

Prior to the said creasing or the like, the material web may be subsequently taken off by an accumulator, such as at least one material roll, trimmed along its longitudinal edges, printed, followed by folding and finally cross-cutting, perforating or similar in order to divide it into single, folded sheet layers for stacking. In this case, over its processing length the material web is constantly under even tensile stress up to the cross-cutting point, with its longitudinal edges being nearly without tension during folding.

BRIEF FIGURE DESCRIPTION

These and other characteristics are described in the claims, the specification and the drawings, with individual characteristics alone or together with others being capable to be realised in sub-combinations in an embodiment of the invention and in other technical fields, representing advantageous designs, for which patentability is claimed per se. An embodiment of the invention, as shown in the drawings, will be described hereafter. In the drawings:

DETAILED DESCRIPTION OF PREFERRED EXAMPLE EMBODIMENTS

Figure 1:
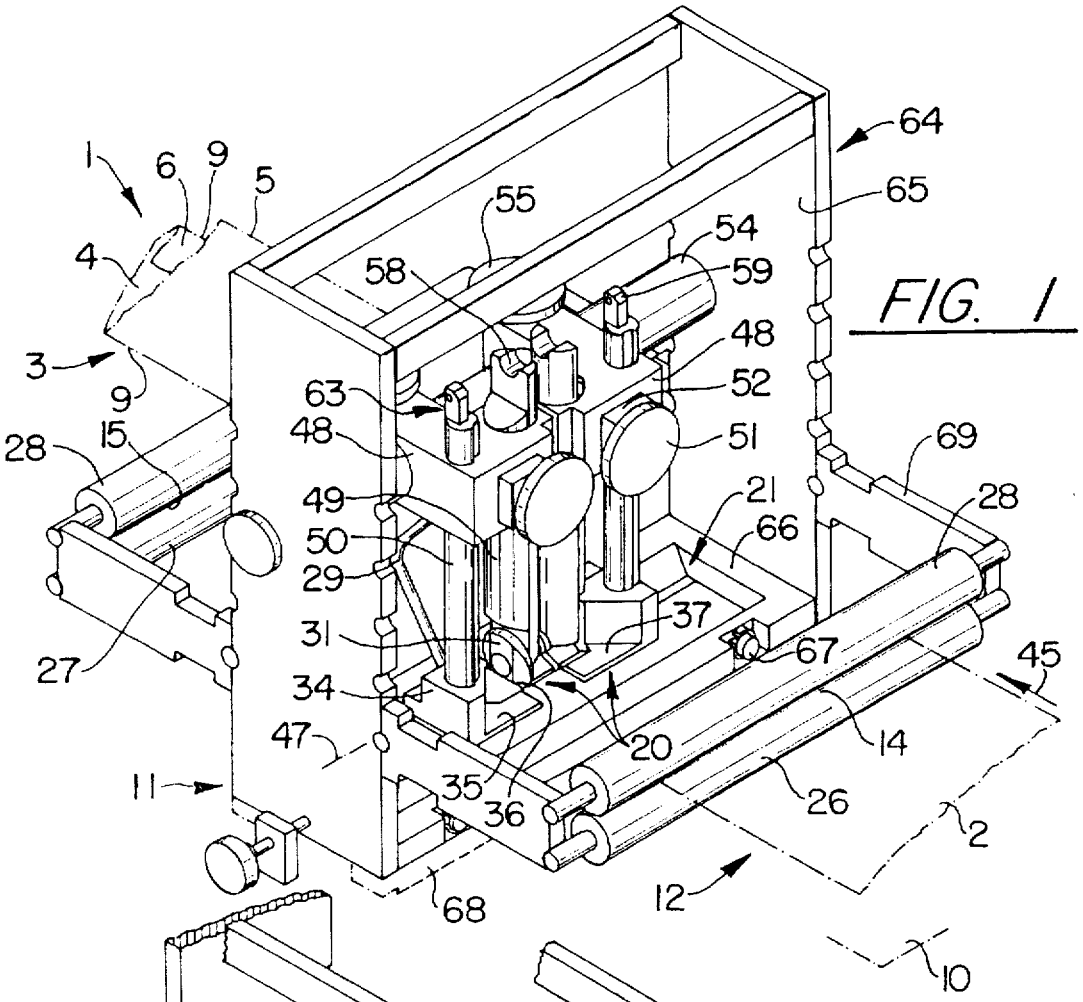
FIG. 1 is an exploded view of the inlet side of the device of the invention.
Figure 2:
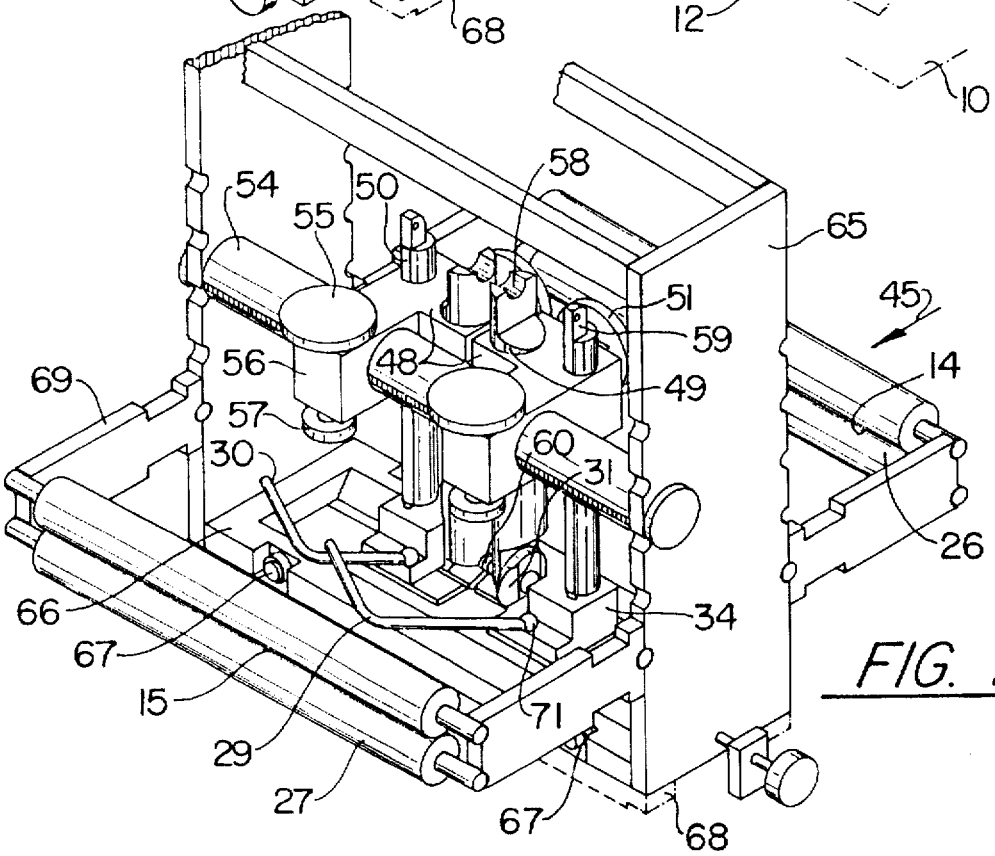
FIG. 2 is a view on the outlet side of the device according to FIG. 1.
Figure 3:
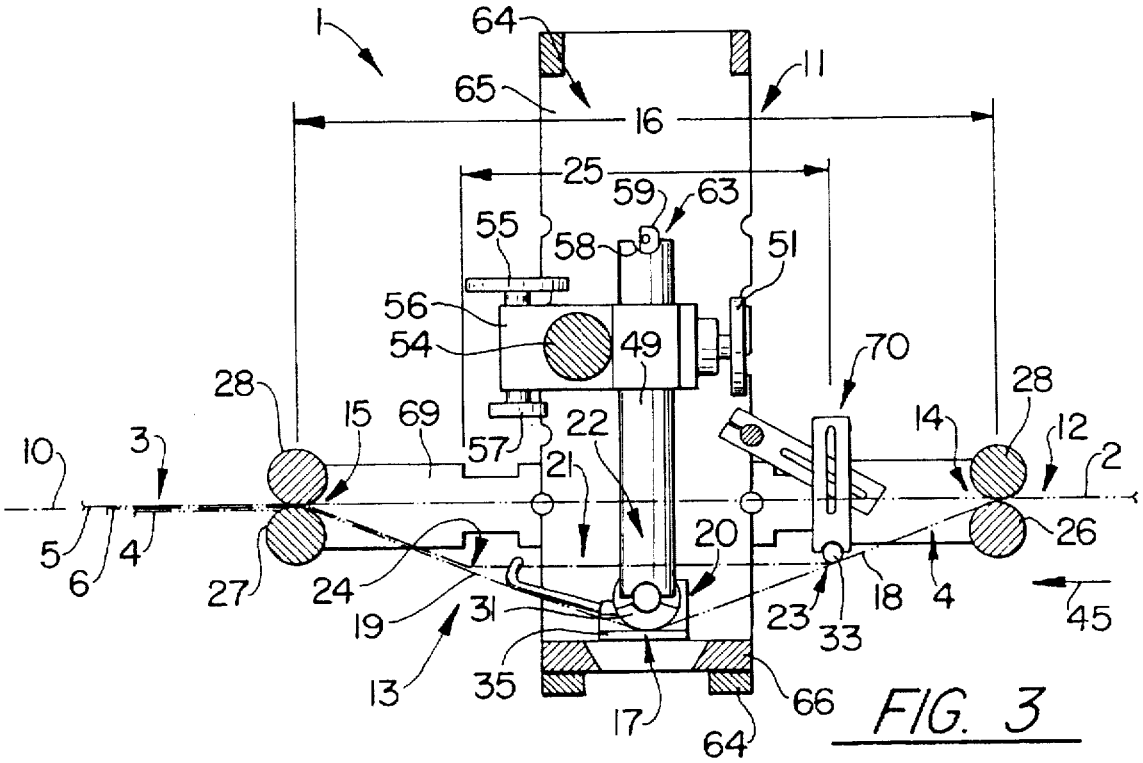
FIG. 3 is a section through the device according to FIGS. 1 & 2.
Figure 4:
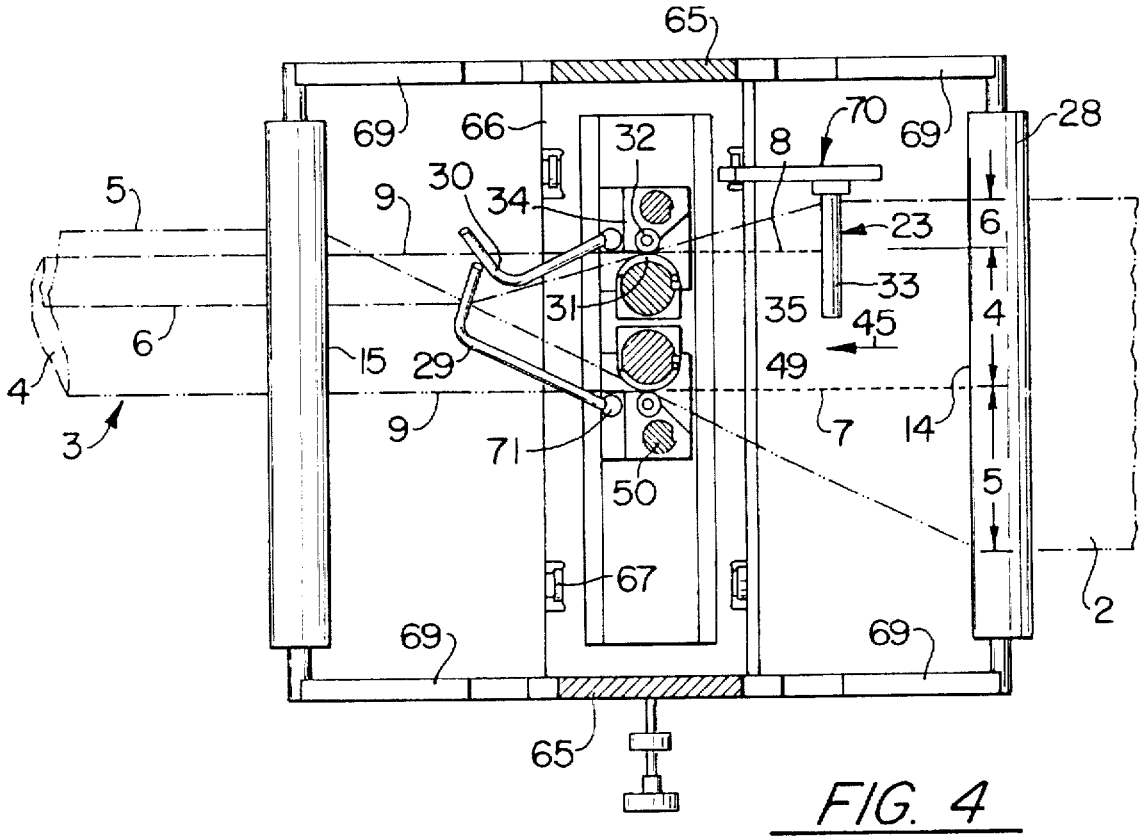
FIG. 4 is a sectional plan view of the invention according to FIG. 3.

The device 1 is used for processing a single or multiple-layer initial or web material 2, which is spread planar, forming after processing a folded finished material 3 of a smaller width, by folding on the same side of a flat central section 4 two edge sections 5, 6 arranged opposite each other and overlapping each other, also being spread planar, allowing all sections 4 to 6 to be arranged side by side as a coil or spiral fold, arranged side by side, with their sides facing each other. Section 6 is narrower than sections 4, 5, and section 4 is narrower than section 5. Sections 4, 5 are connected with each other by a line-shaped connecting area 7 arranged parallel to them, and sections 4, 6 are connected by a corresponding area 8. Areas 7, 8 are forming hinge or folding zones of the material which is in one-part over sections 4 to 6 and areas 7, 8. After folding, fold-outsides of areas 7, 8 form folded or creased edges along the longitudinal edges of section 4, over which section 5 and its free longitudinal edge project laterally, whilst section 6 is arranged between sections 4, 5.

The material 2 is conveyed to the working area of the device 1 in its longitudinal direction, parallel to areas 7, 8 in a path or sectional plane 10 and may leave it as the material 3 on the same level, with all sections 4 to 6 and areas 7, 8 being continuously under even length tension throughout material sections 2, 3 whilst conveying. The device 1 consists of a base 11, such as a frame being static during operation and may be integrated as a station into a conveyor track 12 for the web 2, 3, effecting transport through the device 1. Within this conveyor track 12, the device 1 forms a path or processing section 13 for folding the section 5, having two ends, i.e. an inlet 14 and an outlet 15 in which the web 2 or 3 may be guided free from motion play in cross direction to its plane. The distance between the ends of the section 14, 15 makes up the working length 16 of the device to be measured along the plane 10 between these ends of section 14, 15, adequate for folding both sections 5, 6. Within section 13, the conveying path of section 4, however, is much longer than the length 16, due to this section 4 being deflected downward or upward to an apex 17, arranged at a distance from or at the center between the ends 14, 15, allowing it to be conveyed from the said apex 17 to each end 14 or 15 by one flat leg 18 or 19. The legs 18, 19 arranged in an obtuse angle in relation to each other, may be of the same length, being preferably only connected to each other by a single curved apex section 17 having the shape of part of a circle.

Section 4 will pass over or through to creaser heads 20 on identical axes in the apex, forming the apex deflector, being designed as symmetrically identical plough creaser heads over which the section 4 is sliding over its full width, mainly under continuous tension and in full contact in order to eliminate side movement. The heads 20 are arranged symmetrically as a mirror image on either side of a longitudinal central plane, with their guide areas only being divided by the width of a gap.

Deviation means 21 for the second section 6 are arranged at a distance from and between the ends 14, 15 within length 16, allowing section 6 to be completely folded on section 4 around zone 8 from a position coplanar with section 4, latest by reaching outlet 15. The processing section 22, provided for this purpose, includes ends, as described for section 13, i.e. an inlet 23 and an outlet 24, having a smaller working length 25 in comparison with the length 16. The lengths 16, 25 can be arranged symmetrically to an axial plane of apex 17 oriented at right angles to plane 10.

The ends 14, 15 are each formed by the point of the circumference of a deflector or guide member 26 or 27, such as a rotating roll, from which the web 2 or the leg 18 is released or at which the web 3 or the leg 19 is returned into contact. At this point of the deflector 26, the section 5 commences to be erected around the area 7, and at the said point of the deflector 27 both sections 5, 6 are completely folded on section 4 or each other. An obtuse-angle deflection is effected by deflectors 26, 27, with the material contacting under tension. In order to secure the web 2 or 3 against lifting off, a counterguide 28 is arranged opposite each support 26, 27. The web 2 or 3 can have transverse motion play, no motion play or run under minor pressure in the line-shaped guide gap formed by the support and counter-support.

The outlet 24 of the section 22 is preferably designed as a guide member 30 or a deflector around which the outside of the section 6 facing away from section 4 may be guided, allowing the inside of section 5 not to be touched by section 6 during folding. For section 5, a suitable guide member 29 is provided, arranged, like the guide member 30, at a distance from and between the outlet 15 and creaser shoes 31 of the heads 20. For each shoe 31, in the area of which the appropriate section 5 or 6 has reached a right-angle position in relation to section 4 and which is located on the inside of the associated section 5 or 6, a guide member 32 is arranged opposite the shoe 31 for guiding the outside of the associated section 5 or 6. A guide member 33 is provided between and at a distance from the inlet 14 and the shoes 31, maintaining the section 6 downstream of inlet 14 coplanar with section 4 and forming the inlet 23 of section 22, from where section 6 only begins to be erected around area 8. Erection of section 5 is therefore beginning prior to erection of section 6, with creasing ending after that of section 6. The guide member 33 runs, like guide members 29, 30, on the side of web 2 or 3 facing away from the guides 26, 27, but exclusively on the inside of section 6 and of part of the width of section 4, allowing section 6 permanently not being in contact with section 5 up to completion of the crease.

A further guide member 34 is arranged on the same side as guide member 32. Member 34 secures the associated section 5 or 6 over the major portion of its width against transverse motions. On member 34 the edges 9 may pass in close vicinity or nearly in contact in order to provide a lateral guidance. A further guide member 35 is used for guiding the outside of section 4, facing away from sections 5, 6 in the vicinity of apex 17. Member 35 forms a preassembled module together with guides 32, 34.

Figure 5:
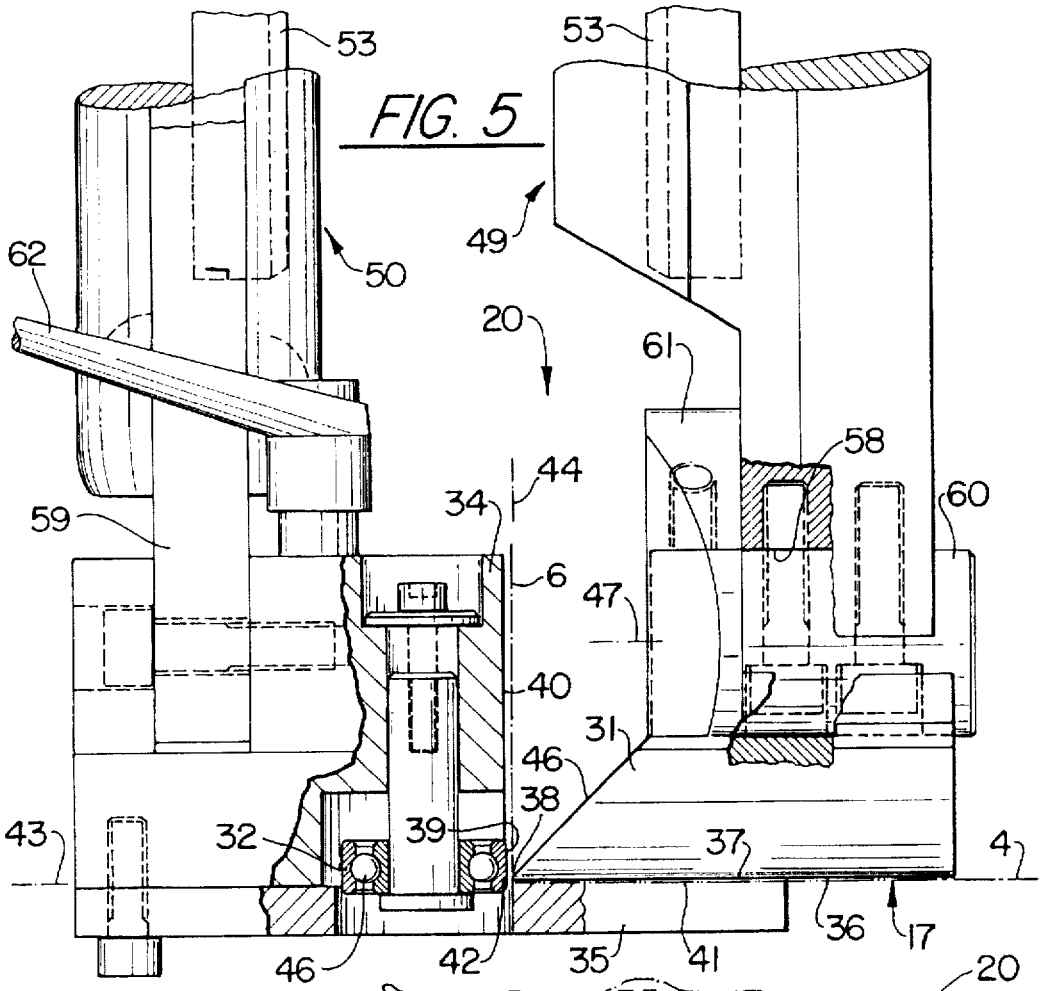
FIG. 5 is an enlarged cut-out view of the outlet side of the invention.
Figure 6:
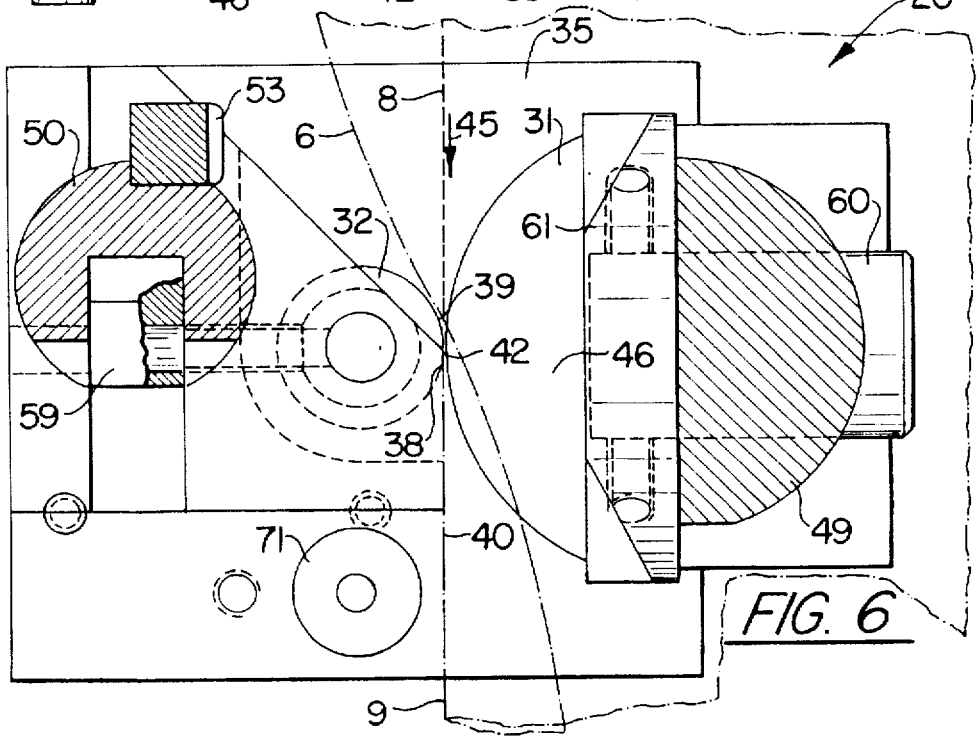
FIG. 6 is a sectional plan view of an arrangement according to FIG. 5.

Shoe 31 includes a guide face 36 curved in accordance with the curvature of the apex and over a larger curvature angle in relation to apex 17. The inside of section 4 is sliding on face 36 formed by a roller. Opposing face 36 at a small distance and in the vicinity of the highest point of the apex, a planar guide face 37 of plate-shaped guide member 35 is located, which is used for guiding the outside of section 4. When seen in conveying direction according to FIG. 5, an end of shoe 31 is inclined towards section 6 or guide 32, 34, thus forming a flank receding from face 36.

Because the associated end of shoe 31, as shown in a view on plane 10, is convexly curved around an axis oriented transverse or at right angles to plane 10, only a point-shaped guiding 38 of the web 2 results in the vicinity of the inside of area 7 or 8. The guide face 39 of guide member 32 directly opposes guide face 38 by a gap spacing and is also correspondingly convexly curved, or arcuate. Both axes of curvature of the arcuate guide faces 38, 39 are located in a common axial plane oriented at right angles to the longitudinal direction of web 2 or 3. On the side more spaced from faces 36, 37 to face 39 a planar guide face 40 of guide member 34 connects. Face 40 can be slightly set back with respect to face 39 and is also used for positionally stabilising the outside of section 6.

Faces 36, 37 closely bound a gap 41 adapted to the thickness of section 4 and its low-friction passage. Gap 41 extends from face 38 over only a section of the transverse extension of face 36, with its narrowest point being line-shaped in a plan view on face 37. Gap 41 is widened in a funnel-like manner at the inlet and outlet only by the curvature of face 36. In a plan view on section 4 or apex 17, the edge or face 38 is curved over a section of a circle by a radius of curvature which is of the same order of magnitude as the radius of curvature of the apex but significantly larger than the curvature radius of face 39. Face 38 is bounded by the planar flank 46 of one-part shoe 31 and also forms together with face 39 an inlet and an outlet expanded like a funnel when seen in said plan view. In the vicinity of the smallest distance between closely spaced faces 38, 39, a point-shaped gap 42 of approximately the same width as gap 41 results and directly connects to gap 41. The gap planes 43, 44 of both gaps 41, 42 are oriented at right angles to each other. Gap 42 is used for substantially exclusively guiding in the vicinity of area 7 or 8, whilst already the areas of sections 5 or 6 directly connecting thereto have larger lateral freedom of movement in the direction towards shoe 31 or flank 46. In the associated counterdirection section 5 or 6 or edge 9 runs directly adjacent to face 40 forming a sliding flank of the outlet, which flank connects downstream to gap 42.

Face 39 is formed by the external circumference of an external ring of an anti-friction bearing 46, is rotatable around an axis oriented at right angles to face 37 and countersunkly engages in an opening in face 37, thus crossing plane 43 and touching plane 44. Member 32 may be mounted on member 34 by means of an excenter or the like, for continuously adjusting the width of gap 42. Member 35 is a plate fastened to member 34, with the width of the gap 41 being adjustable at random by adding spacers between the support faces. Each of shoe 31, the axis of member 32 and member 35 are continuously adjustable about a cross axis 47 oriented at right angles to direction 45 or parallel to plane 10. This substantially common cross axis being the axis 47 of the apex curvature 17.

Shoe 31 on the one hand and members 32, 34, 35 are in each case fastened to the end of a support 49 or 50 in a projecting manner. Both supports 49, 50 are formed by parallel rods and are synchronously and continuously adjustable transverse to plane 10 by being displaceably mounted on a support body 48 in order to adjust the height of apex 17. Displacement is made by a handle 51 via a transmission 52 in body 48 such as if supports 49, 50, arranged at a distance from each other, were positively interlocked without reciprocal motion play. For that purpose, the supports 49, 50 include racks 53 provided with toothings which opposingly face each other and in which two matching gear rotors of gear 52 engage, one of which is rigidly connected to handle 51. The width of gap 41 can be continuously varied also by adjusting the transmission 52 or by reciprocal displacement of the separate supports 49, 50. For each pair of two guide members 31, 34 or for each section 5 or 6, a separate adjustment and a separate body 48 is provided.

Both supports 49, 50 of each pair are passing through the associated support body 48 which is individually and separately supported as a slide on a guide 54 to be displaceable approximately parallel to axis 47 by a handle 55 via a gear transmission 56 in order to adjust the width of the sections 4 to 6 or to adapt the device 1 to webs 2, 3 of different widths. The guide member 54 is formed by cylindrical rod including a sarrated rack for engagement of a pinion of each transmission 56. By axially restraining this pinion like also the slide 48 can be releasably locked with respect to guide 54 or base 11 with a handle of a locking means 57. A similar locking means may be provided for the transmission 52. The distance between the two supports 49, 50 of each pair and therefore the width of gap 42 is always maintained during transverse adjustment over the working width.

At its end the associated support 49 or 50 is provided with a reception 58, 59 for non-destructive detachably and exchangeably fixing shoe 31 or a guide member 32, 34, 35, the reception 58, 59 simultaneously forming a bearing member for the adjustment oriented around axis 47. Recess 58 is of tray bushing shape and designed for radial insertion and clamping of a cylindrical bearing insert 60. The shoe 31 may be axially and linearly plugged onto the free projecting end of insert 60 in the vicinity of a niche formed by a support 49 with a circular or plate-shaped support element 61 and fixed in a random pivoted position by clamping. Support element 61 connects to a flank 46, and adjacent to member 61 the shoe 31 forms a counter-bushing for support against insert 60. Reception 59 provides a plate-shaped bearing projection including a bearing aperture located in axis 47, the projection engaging into a slot of member 34, so as to be pivotable around an axis 47. Thereby all members 32, 34, 35 can be commonly adjusted around axis 47 and locked with respect to support 50 by clamping with a handle 62 of a locking means.

Each support 49, 50 includes identical receptions 58, 59 on both ends projecting over slide member 48, allowing the shoe 31 and members 32, 34, 35 to be optionally or alternately arranged on either end of the associated support 49, 50, as described, in order to provide apex guide suspended below or standing above plane 10. Members 32, 34, 35 can therefore be reversingly assembled as a preassembled module. The described conversion means 63 results in a highly variable operating mode of the device 1. Only a single crease may also be produced.

The base 11 includes a preassembled frame 64 including two plate-shaped jaws 65 reciprocally opposingly standing on both sides of the working width and rigidly interconnected by cross bracing. At the lower end cheeks 65 are rigidly interconnected by a plate-shaped or frame-shaped plinth 66 oriented parallel to plane 10. Frame 64 may be mobile due to runners 67 or castors, not only on any planar base, but also on two rail-shaped supports 68 of a plinth frame, thereby allowing non-destructive removal or assembly in a transverse direction oriented transverse to direction 45 and parallel to plane 10. The plinth frame is to be arranged on a foundation on the floor, allowing the unit 1 to be supported on the floor only via the plinth frame for removal at any time. The connection between the frame 64 and the plinth frame or support 68 includes adjusting means for continuously positionally adjusting the device 1 in relation to the plinth frame in the direction of the working width and around an axis located within this working width and oriented upright transverse to plane 10.

Guide means 54 are connected to a jaw 65 only with its ends, with the two bodies 48 each being adjustable up to contact with each other and to abutment on the adjacent jaw 65. On both sides of each jaw 65 projecting bearing shields 69 for bearing the guide members 26 to 28 are fixed in an orientation coplanar with the associated shield 69, members 26 to 28 thereby being arranged at a distance in front of and behind the jaws 65. Shields 69 provide freely projecting cantilever arms, and can be positionally adjusted in continuous mode or step mode with respect to the frame 64 or jaws 65 in a cross direction transverse to plane 10, in order to adjust the apex height of section 13 or 22 by these means. The distance of the end 14 or 15 in relation to the apex 17, too, the jaws 65, may be continuously variable or variable in steps in direction 45, the apex 17 being located between jaws 65.

The said positional adjustments also apply to the end 23 of section 22, for which a guide member 33 is arranged on a support 70 consisting of two hinged first and second support parts which are also reciprocally adjustable in their longitudinal directions and can be rails, levers or the like. The end of the first support part is attached to an infeed edge of the associated jaw 65 so as to be positionally adjustable around a first axis oriented parallel to the deflection axes and transverse to plane 10. This adjustability may be continuous or in steps, whereby this support part is replaceably attached to be detachable in a non-destructive manner. At a distance from this attachment the first support part is connected to the second support part allowing the second support part also to be pivoted in relation to the first support part around a second axis oriented parallel to the first axis. Thereby guide member 33 can be randomly and continuously adjusted in direction 45 and transverse to plane 10 and transverse over the working width.

Each of the guide members 29, 30 mounted with a hinge 71 like a freely pivotable ball joint at a top side of the associated member 34, the ball head of which is rigidly attached to one end of member 29 or 30 and pivotably as well as lockably received in a ball cup of member 34. Should members 32, 34, 35 be lockable in relation to reception 59 by clamping a threaded trunnion defining their axis 47, handle 62 may be provided for locking the hinge 71. Member 29 or 30 is thus continuously adjustable around the ball center in each direction by a minimum of 90°, 120° or 180°. The projecting member 29 or 30 designed as a freely projecting arm can thus be pivoted transverse to plane 10, sideways and parallel in relation to plane 10 and around its longitudinal axis connecting to joint 71 in random positions. Furthermore, commonly with the hinge head member 29 or 30 can non-destructively be released from its support and can be exchanged against another.

Member 29 or 30 formed by a bent round bar, includes two legs reciprocally oriented at right angles and connecting to each other via a curvature, with the end of one leg being used for attaching to member 34. The other, shorter leg projects freely. The mobile bearing 71 is pivotable around axis 47 together with the remaining members 32, 34, 35. Members 29, 30 respectively engage the outsides of sections 5, 6 at a distance from and approximately in the center between guide areas 15, 42, allowing these sections 5, 6 to be safely conveyed into the overlying position. For this purpose, member 29 could also engage the inside of section 5, i.e. with its angular or line-shaped guide face. All guide members or guide faces are optionally used for securing the position, supporting and aligning the associated section of the web 2 or 3.

The web 2 is guided to the inlet 14 in a planarly spread state under longitudinal tension in direction 45. Directly downstream of inlet 14 section 5 begins to be erected and folded over. Section 6 only begins to be also erected after leaving the inlet 23 and prior to reaching the apex 17. Section 5 requires a longer length than section 6 for erection into rectangular position in relation to section 4 at the guide point 17 or 42. With respect to section 5, section 6 also requires a shorter length from this point to the finished crease lying on section 4. After leaving point 17 or 42, section 6 is therefore folded under section 5 and may already be positioned flat on section 4 at the outlet 24 defined by member 30. Up to the outlet 15, section 5 is completely folded over on sections 4, 6. In the vicinity of outlet 15, sections 4 to 6 may be pressed onto each other, with the creases 9 being reworked as line-shaped breaks. During its entire passage, section 4 remains in a spread extended position, whereby section 4 is planar in each cross-section transverse to direction 45. Face 39 may be eliminated, with its function being realised by face 40 alone.

Depending on requirements, all properties and characteristics described may be provided accurately or only approximately or substantially as described. Furthermore, each component or arrangement may be provided single, twice or more times.

We claim:

1. A device for folding layer material to a folded state in which the layer material defines layer sections including first and second folded layer sections folded to a common side of a connecting layer section interconnecting the folded layer sections, the first folded layer section defining a first section width extension and the second folded layer section defining a second section width extension, said device comprising:

a device base;

a conveying path for conveying the layer material with respect to said device base; and, folding means including guiding means for longitudinally folding the layer material from an initial layer state to the folded state along a folding path section of said conveying path and while displacing the layer material with respect to said device base, said folding path section defining folding path ends including a beginning end where the layer material begins to be folded by partly erecting the layer material from the initial layer state, said folding path ends further including a finishing end where the layer material reaches and then maintains the folded state, from said beginning end to said finishing ends, said folding path section defining a direct linear folding length extension, from said beginning end to said finishing end the layer material being longer than said folding length extension, said folding and guiding means including plow means including a plow deflector for transversely deflecting the connecting layer section while simultaneously folding the first and second layer sections with respect to the connecting layer section to the folded state from said beginning end to said finishing end; and, control means being included for directly opposingly folding both the first and second layer sections while the first section, width extension is different from the second section width extension.

2. The device according to claim 1, wherein said folding means are provided for simultaneously folding both said folded layer sections said folding path section including a first folding path section for folding the first folded layer section and a second folding path section for folding the second folded layer section, said beginning end including a first beginning end of said first folding path section where the first folded layer section begins to be folded and a second beginning end of said second folding path section where the second layer section begins to be folded, said finishing end including a first finishing end of said folding path section where the first folded layer section reaches the folded state and a second finishing end where the second layer section reaches the folded state, said first and second beginning ends defining an associated beginning end couple and said first and second finishing and defining an associated finishing end couple, said folding length extension including a first folding length extension between said first beginning end and said first finishing end and also including a second folding length extension between said second beginning and and said second finishing end, commonly said first and second folding path sections extending over a linear common length extension shorter than at the most two to one and a half times said first folding length extension, said folding path ends of at least one of said end couples being spaced with respect to each other.

3. The device according to claim 2, wherein said plow means are provided for guiding the connecting layer section to achieve an apex configuration between said folding path ends, said folding means being provided for folding at least one of said folded layer sections about a linear connecting zone directly connecting the folded layer sections with the connecting section.

4. The device according to claim 3, wherein said second folding path section is entirely located between said folding path ends of said first folding path section and spaced from both said folding path ends of said first folding path section.

5. The device according to claim 4, wherein said plow means is provided for deflecting the connecting layer section away from linearly connecting said folding path ends, said plow means including a first plow deflector for folding the first folded layer section and a second plow deflector for folding the second folded layer section, said plow means engaging the layer material exclusively within said folding path section, said first plow deflector being opposed by a web guide for guiding the layer material directly opposite to said first plow deflector.

6. The device according to claim 3, wherein by connecting said folding path ends a path plane is defined, within said folding path section and upstream of said apex configuration said folding means, including guide members for guidingly engaging the second folded layer section, said guide members being displaced with respect to at least one of said folding path ends of said first folding path section transverse to said path plane, said guide members being entirely free of contact with the first folded layer section.

7. The device according to claim 2, wherein said folding means are provided for guiding the connecting section over an apex when seen in a side view on the layer material, at least one of said folding path ends of said second folding path section being located between and spaced from said folding path ends of said first folding path section and said apex.

8. The device according to claim 7, wherein said apex includes only a single common apex for both said first and second folding path sections, said plow deflector including a first plow deflector for deflecting the connecting layer section directly adjacent to the first folded layer section and a second plow deflector for deflecting the connecting section directly adjacent to the second folded layer section, said first and second plow deflectors being opposed by at least one layer guide for guiding the layer material on a layer side remote from that first and second plow deflector.

9. The device according to claim 2, wherein at least one of said folding path ends of at least one of said first and second folding path sections is individually displaceably mounted, positioning means being provided for operationally blocking said at least one folding path end in any of a plurality of end positions, three reciprocally perpendicular coordinate directions being defined, said at least one folding path end being continuously displaceable in one to three of said coordinate directions.

10. The device according to claim 1, wherein a path plane is defined interconnecting said folding path ends, and further comprising conversion means for alternately folding the layer material in opposing directions oriented transverse to said path plane.

11. The device according to claim 1 and defining an arcuated apex of the layer material, the apex defining an apex axis, a path plane interconnecting said folding path ends being defined, wherein said folding means include at least one guide member for guidingly engaging the layer material, at least one of said guide member being positionally adjustable about a guide axis located on a plane side of said path plane, said plane side opposing said apex, an apex axis plane including the apex axis and oriented parallel to said path plane being defined, said guide axis being located closer to said apex axis plane than to said path plane.

12. A device for folding layer material to a folded state in which the layer material defines layer sections including at least one folded layer section and a connecting layer section laterally directly connecting to the at least one folded layer section, the layer material defining a layer plane defining a first plane side and a second plane side remote from said first plane side, said device comprising:

a device base;

a conveying path for conveying the layer material with respect to said device base in a conveying direction, said conveying path including a folding path section; and, plow folding means including guiding means for longitudinally folding the layer material from an initial layer state to the folded state only within said folding path section and while the layer material is conveyed through said folding path section, said folding path section defining folding path ends including a beginning end where the layer material initially begins to be folded by partly erecting the at least one folded layer section from the initial layer state with respect to the connecting layer section and with respect to said device base, said folding path ends further including a finishing end where the layer material reaches and then maintains the folded state, said guiding means including a plow deflector for engaging and transversely deflecting the connecting layer section while simultaneously folding the at least one folded layer section to the folded state from said beginning end to said finishing end, wherein between said folding path ends and spaced from said folding path ends a guide member is provided for engaging and guiding the at least one folded layer section while the layer material is conveyed and folded, said guide member moving with respect to said device base during said engaging and guiding.

13. The device according to claim 12, wherein said guide member includes a guide roll mounted to rotate about a single roll axis oriented transverse to the connecting layer section.

14. A device for folding conveyed layer material, comprising:

a device base;

a plow deflector disposed on said device base and having a deflecting apex;

said plow deflector having a first arcuate surface closely spaced from an opposing flat surface on said devise base an defining a first gap leg therebetween aligned with the layer material conveyed past said plow deflector, said first arcuate surface having a planar end disposed at an angle to said opposing flat surface and defining said deflecting apex;

said deflecting apex being closely spaced from a second arcuate surface on said device base, said second arcuate surface having an axis substantially perpendicular to said flat surface and defining a second gap leg between said deflecting apex and said second arcuate surface;

said first and second gap legs being connected to one another at said deflecting apex and defining a deflecting angle; and, said plow deflector deflecting and folding the conveyed layer material over said deflecting apex of said plow deflector, said first and second gap legs together forming a guiding gap for receiving and directly opposingly guiding the conveyed layer material.

15. A device for folding layer material to a folded state in which the layer material defines layer sections including at least one folded layer section and a connecting layer section laterally directly connecting to the at least one folded layer section, the layer material defining a layer plane defining a first plane side and a second plane side remote from said first plane side, said device comprising:

a device base;

a conveying path for conveying the layer material with respect to said device base in a conveying direction, said conveying path including a folding path section; and, plow folding means including guiding means for longitudinally folding the layer material from an initial layer state to the folded state only within said folding path section and while the layer material is conveyed through said folding path section, said folding path section defining folding path ends, wherein said guiding means includes at least one guide member for directly engaging the layer material, said guide member being mounted on a guide support, said guide support including mounting receptions (58, 59) on both said first and second plane sides of said layer plane, said mounting receptions being provided for selectively holding at least one of said guide members in an operating state on either of said first and second plane sides.

16. A device for folding layer material to a folded state in which the layer material defines layer sections including at least one folded layer section and a connecting layer section laterally directly connecting to the at least one folded layer section, the layer material defining a layer plane defining a first plane side and a second plane side remote from said first plane side, said device comprising:

a device base:

a conveying path for conveying the layer material with respect to said device base in a conveying direction, said conveying path including a folding path section; and, plow folding means including guiding means for longitudinally folding the layer material from an initial layer state to the folded state only within said folding path section and while the layer material is conveyed through said folding path section, said folding path section defining folding path ends, wherein said guiding means includes guide members for directly engaging the layer material separate from said plow deflector and at locations spaced from said plow deflector with respect to said conveying direction, said guide means including at least one guide member for engaging the at least one folded layer section, said guide member being mounted on a guide support positionally displaceable commonly with said plow deflector.

17. A device for folding layer material to a folded state in which the layer material defines layer sections including at least one folded layer section and a connecting layer section laterally connecting to the at least one folded layer section the layer material defining a layer plane defining a first plane side and a second plane side remote from said first plane side, said device comprising:

a device base;

a conveying path for conveying the layer material with respect to said device base in a conveying direction, said conveying path including a folding path section, and plow folding means including guiding means for longitudinally folding the layer material from an initial layer state to the folded state only within said folding path section and while the layer material is conveyed through said folding path section, said folding path section defining folding path ends including a beginning end where the layer material initially begins to be folded by partly erecting the at least one folded layer section from the initial layer state with respect to the connecting layer section and with respect to said device base, said folding path ends further including a finishing end where the layer material reaches and then maintains the folded state, said guiding means engaging the connecting layer section while simultaneously folding the at least one folded layer section to the folded state from said beginning end to said finishing end, wherein at said first and second plane sides the layer sections define remote layer sides, within said folding path section said guiding means including guide members for engaging and guiding at least one of the material section on both the layer sides, with respect to said device base said guide members being commonly positionally and continuously displaceable in at least one direction.

18. The device according to claim 17, wherein guide member said guide members define inclination orientations with respect to said layer plane and are commonly continuously adjustable to achieve each of said inclination orientations.

19. A device for folding layer material to a folded state in which the layer material defines layer sections including at least one folded layer section and a connecting layer section laterally directly connecting to the at least one folded layer section, the layer material defining a layer plane defining a first plane side and a second plane side remote from said first plane side, said device comprising:

a device base;

a conveying path for conveying the layer material with respect to said device base in a conveying direction, said conveying path including a folding path section; and, plow folding means including guiding means for longitudinally folding the layer material from an initial layer state to the folded state only within said folding path section and while the layer material is conveyed through said folding path section, said folding path section defining folding path ends including a beginning end where the layer material initially begins to be folded by partly erecting the at least one folded layer section from the initial layer state with respect to the connecting layer section and with respect to said device base, said folding path ends further including a finishing end where the layer material reaches and then maintains the folded state, said guiding means engaging the connecting layer section while simultaneously folding the at least one folded layer section to the folded state from said beginning end to said finishing end wherein said guiding means includes guide members for guidingly engaging the layer material, said guide members being selectively firstly separately and secondly commonly displaceable in a lateral direction oriented transverse to said conveying direction and parallel to said layer plane and in a direction transverse to said layer material, at least two of said guide members being mounted on a compound slide.

20. A device for folding layer material to a folded state in which the layer material defines layer sections including at least one folded layer section and a connecting layer section laterally directly connecting to the at least one folded layer section, the layer material defining a layer plane defining a first plane side and a second plane side remote from said first plane side, said device comprising:

a device base:

a conveying path for conveying the layer material with respect to said device base in a conveying direction, said conveying path including a folding path section: and, folding means including guiding means for longitudinally folding the layer material from an initial layer state to the folded state only within said folding path section and while the layer material is conveyed through said folding path section, said folding path section defining folding path ends including a beginning end where the layer material initially begins to be folded by partly erecting the at least one folded layer section from the initial layer state with respect to the connecting layer section and with respect to said device base, said folding path ends further including a finishing end where the layer material reaches and then maintains the folded state, said guiding means deflecting the connecting layer section while simultaneously folding the at least one folded layer section to the folded state from said beginning end (14. 23) to said finishing end, wherein said guiding means include a first guide member for guidingly engaging the layer material on said first plane side and a second guide member for guidingly engaging the layer material on said second plane side while opposing said first guide member, said first and second guide member being positionally adjustable about a substantially common guide axis.

21. A device for folding layer material to a folded state in which the layer material defines layer sections including at least one folded layer section and a connecting layer section laterally directly connecting to the at least one folded layer section, the layer material defining a layer plane defining a first plane side and a second plane side remote from said first plane side, said device comprising:

a device base;

a conveying path for conveying the layer material with respect to said device base (11) in a conveying direction, said conveying path including a folding path section; and, plow folding means including guiding means for longitudinally folding the layer material from an initial layer state to tie folded state only within said folding path section and while the layer material is conveyed through said folding path section, said folding path section defining folding path ends including a beginning end where the layer material initially begins to be folded by partly erecting the at least one folded layer section from the initial layer state with respect to the connecting layer section and with respect to said device base, said folding path ends further including a finishing end where the layer material reaches and then maintains the folded state, said guiding means including a plow deflector for engaging and transversely deflecting the connecting layer section while simultaneously folding the at least one folded layer section to the folded state from said beginning end to said finishing end, wherein said guiding means includes at least one guide member including a guiding face for guidingly engaging the layer material, said guiding face being oblong along a length extension and simultaneously linearly engaging the layer material along said length extension, said at least one guide member including a freely projecting guide arm providing said guiding face, along said length extension and in plan view on the layer material said guiding face extending in varying directions.

22. A device for folding layer material to a folded state in which the layer material defines layer sections including at least one folded layer section and a connecting layer section (4) laterally directly connecting to the at least one folded layer section, the layer material defining a layer plane defining a first plane side and a second plane side remote from said first plane side, said device comprising:

a device base;

a conveying path for conveying the layer material with respect to said device base (11) in a conveying direction, said conveying path including a folding path section; and, folding means including guiding means for longitudinally folding the layer material from an initial layer state to the folded state only within said folding path section and while the layer material is conveyed through said folding path section, said, folding path section defining folding path ends including a beginning end where the layer material initially begins to be folded by partly erecting the at least one folded layer section from the initial layer state with respect to the connecting layer section and with respect to said device base, said folding path ends further including a finishing end where the layer material reaches and then maintains the folded state, said guiding means folding the at least one folded layer section to the folded state from said beginning end to said finishing end, wherein said guiding means include at least one guide member for guidingly engaging the layer material, a ball hinge defining a ball center point being provided for positionally adjusting said at least one guide member over an adjusting angle, said ball hinge including a ball head and a ball socket receiving said ball head, said ball head being pivotable with respect to said ball socket about said ball center point parallel and transverse to said layer plane.

* * * * *